United States Patent [19]

McKenna

[11] Patent Number: 4,955,425

[45] Date of Patent: Sep. 11, 1990

[54] CASTING HANDLING APPARATUS

[76] Inventor: James F. McKenna, 2605 Chandalar La., Pelham, Ala. 35124

[21] Appl. No.: 245,504

[22] Filed: Sep. 19, 1988

[51] Int. Cl.[5] ..... B22D 29/00

[52] U.S. Cl. ..... 164/269; 164/270.1; 164/404; 209/235; 209/238; 209/241

[58] Field of Search ..... 164/269, 270.1, 404; 209/235, 238, 240, 241, 248, 257

[56] References Cited

U.S. PATENT DOCUMENTS

| | | | |
|---|---|---|---|
| 1,159,707 | 11/1915 | Peterson | 209/248 X |
| 1,929,538 | 10/1933 | Spikerman et al. | 209/241 X |
| 3,724,659 | 4/1973 | Bührer | 209/238 |
| 4,501,313 | 2/1985 | Weis et al. | 164/269 X |

FOREIGN PATENT DOCUMENTS

| | | | |
|---|---|---|---|
| 2647129 | 4/1978 | Fed. Rep. of Germany | 164/269 |
| 2737733 | 3/1979 | Fed. Rep. of Germany | 164/404 |
| 3030497 | 3/1981 | Fed. Rep. of Germany | 164/269 |

*Primary Examiner*—Nicholas P. Godici
*Assistant Examiner*—J. Reed Batten, Jr.
*Attorney, Agent, or Firm*—Jennings, Carter, Thompson & Veal

[57] ABSTRACT

Apparatus for non-impact handling of foundry castings utilizes a sand pervious basket to receive a sand mold and casting and to segregate the casting from the mold. A turntable assembly lifts and translates the basket to a secondary conveyor which removes the casting for further processing. The secondary conveyor may be a walking beam conveyor adapted to operate inside a quenching tank and the basket adapted to align with the walking beam conveyor for removal of the casting.

23 Claims, 5 Drawing Sheets

CASTING HANDLING APPARATUS

FIELD OF THE INVENTION

The present invention relates to the field of foundry casting and more particularly to the handling of hot foundry castings while such castings are removed from the associated molds. In even greater particularity the present invention relates to sand casting such as utilized in lost foam sand casting. More particularly the present invention relates to the segregation of the casting and sand and transportation of the casting for further processing.

It is well known in the art that hot castings, particularly aluminum are susceptible to handling damage upon exiting the mold and for a period of time thereafter. Thus compressing forces and impacting forces must be avoided to insure that a high percentage of the foundry castings remain unblemished by handling.

SUMMARY OF THE INVENTION

It is the object of the present invention to provide a system for receiving a hot casting and sand mold, segregating the casting from the mold and transporting the casting for further processing with minimal damage to the casting due to handling.

It is a further object of the invention to provide such a system which is capable of handling a continuous series of castings as they are discharged from a continuously operating foundry casting system.

Yet another object of the invention is to provide additional cooling to the casting while the casting is being transported.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
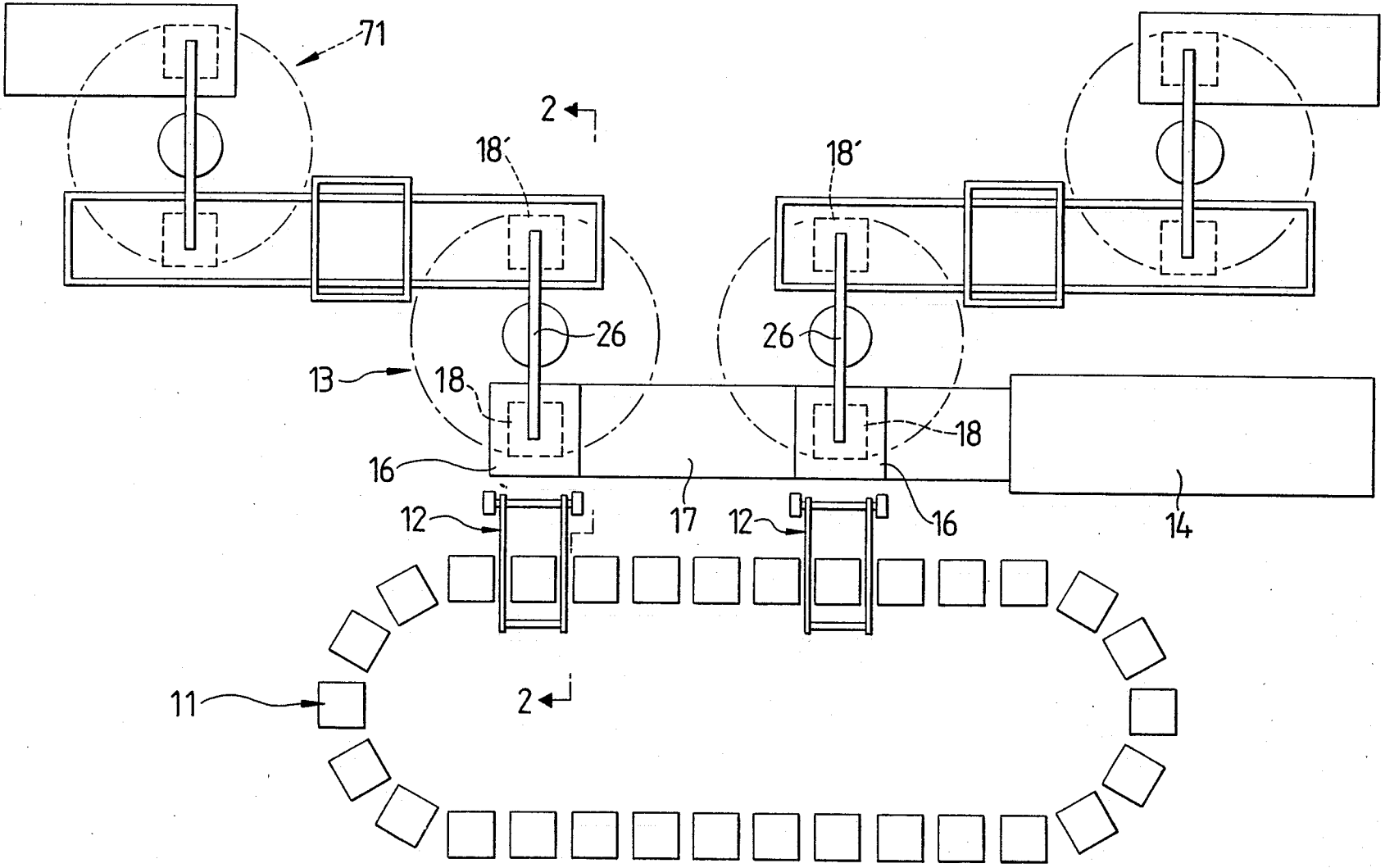
FIG. 1 is a plan view of a tandem casting handling apparatus in accordance with my invention.

Referring to the drawings for a clearer understanding of my invention it will be appreciated that this apparatus is designed for use in conjunction with a sand mold casting system such as described in U.S. Pat. No. 4,736,787 owned by the common assignee herewith. In FIG. 1, such a casting system is depicted at 11 and has a pair of tandem dump stations 12 which remove the sand and casting from the casting system 11 to my handling apparatus depicted generally at 13. My apparatus 13 includes a receiving station 16 for each dump station. Each receiving station includes a support 17 for receiving sand from the dump station 12. In the embodiment shown the support 17 is a vibrating screen type conveyor which is conventional in the industry, and which moves the sand to a bin 14 from where it can be recirculated to the casting system 11. It will be appreciated that a dump table might also serve as support 17, in as much as the primary function of the support 17 is to accumulate the sand as it is dumped to cushion the landing of the enclosed casting and then to remove the sand for recirculation. It is noteworthy to mention that It Is the accumulation of sand which prevents damage to the casting; thus a sufficient depth of sand must be accumulated on support 17 to cover the lower portion of a basket 18 into which the sand and casting are deposited.

Figure 2:
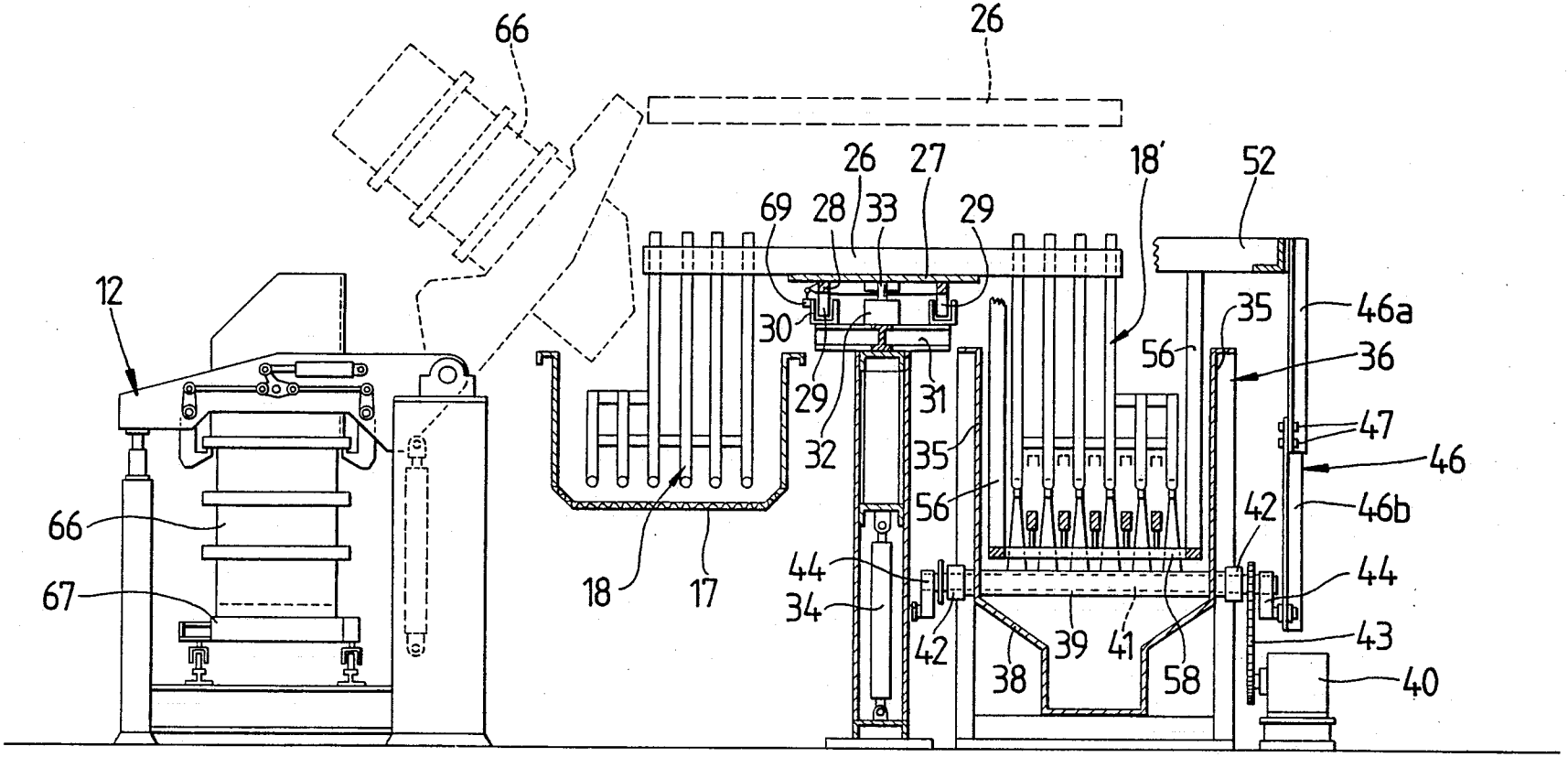
FIG. 2 is a sectional view of FIG. 1 indicated by line 2—2 showing a dump station in a lost foam casting system and my handling system adjacent thereto for receiving the castings and molds discharged thereby.
Figure 5:
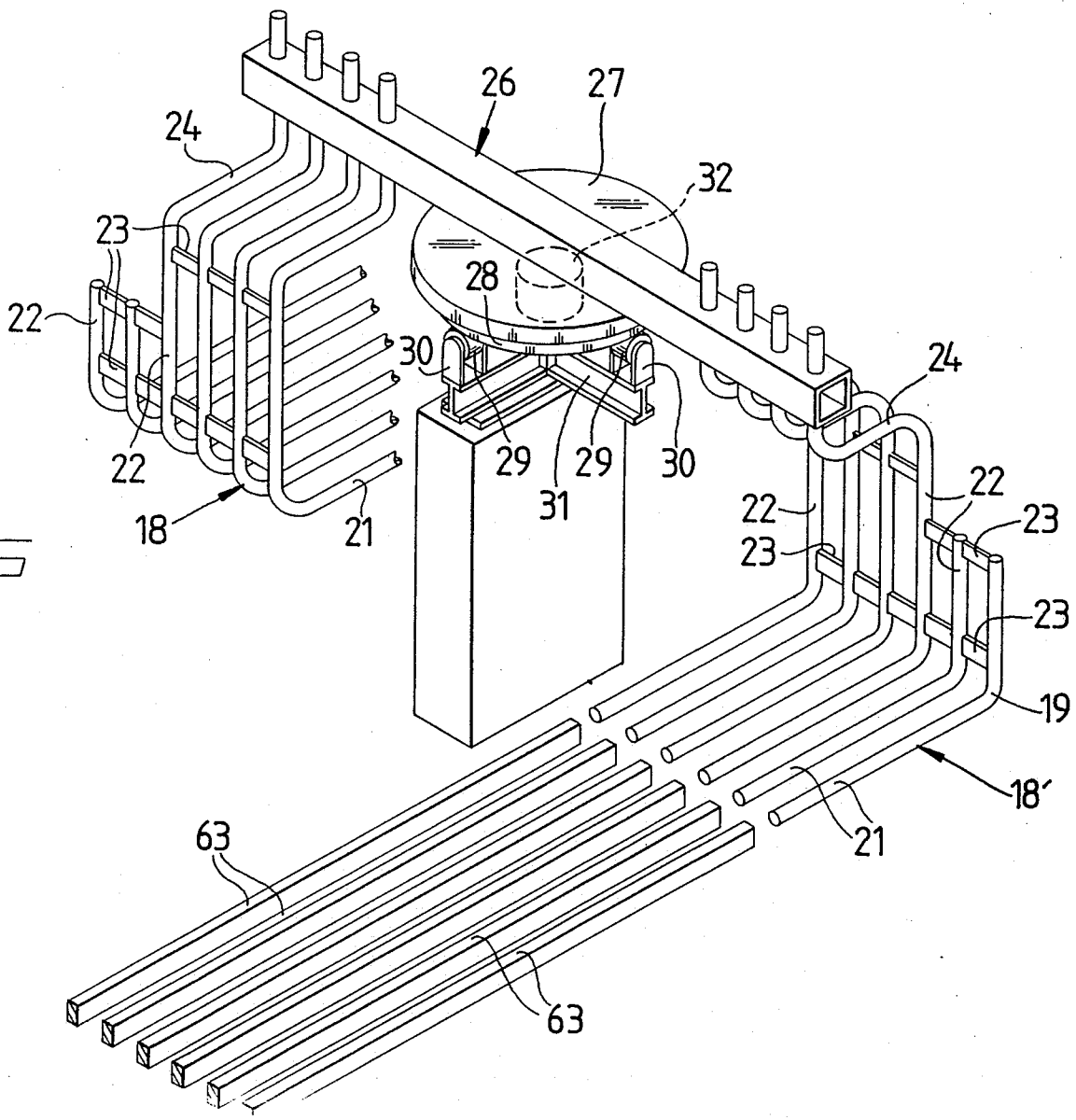
FIG. 5 is a perspective view of my basket and turntable assembly.

Preferably the basket 18 is made of a plurality of parallel structural members 19 (see FIGS. 2 and 5) which have a first portion 21 extending horizontally and a second portion 22 extending vertically. The structural members 19 are connected to each other by spacer bars 23 and a number of members 19 on the side of the basket 18 away from the dump station 12 have an upper portion 24 which extends upwardly and are connected to a turntable beam 26. As can be seen the baskets 18 are open on three sides and sand can readily pass between the structural members 19.

Beam 26 supports the basket 18 and an identical basket 18' at its opposite ends. The beam 26 and baskets 18, 18' are mounted to a turntable-like assembly including a disk-like plate 27 supported on an annular rail 28 which in turn rests on several casters 29 which are mounted for rotation about horizontal axis in brackets 30 attached to a support member 31 which forms a cross. At the center of the support member 31 is a drive unit 32, which may be a hydraulic motor, or hydraulic rotary actuator, which has a vertical output shaft 33 affixed to the underside of plate 27.

The support member 31 is affixed to the top of a vertical ram 34 or hydraulic actuator which can be extended to lift the beam 26 to a height such that the lower portion of the baskets 18, 18' are above the height of the sidewalls of the sand support members 17, and above the height of the sidewalls 35 of a quenching tank 36.

Figure 3:
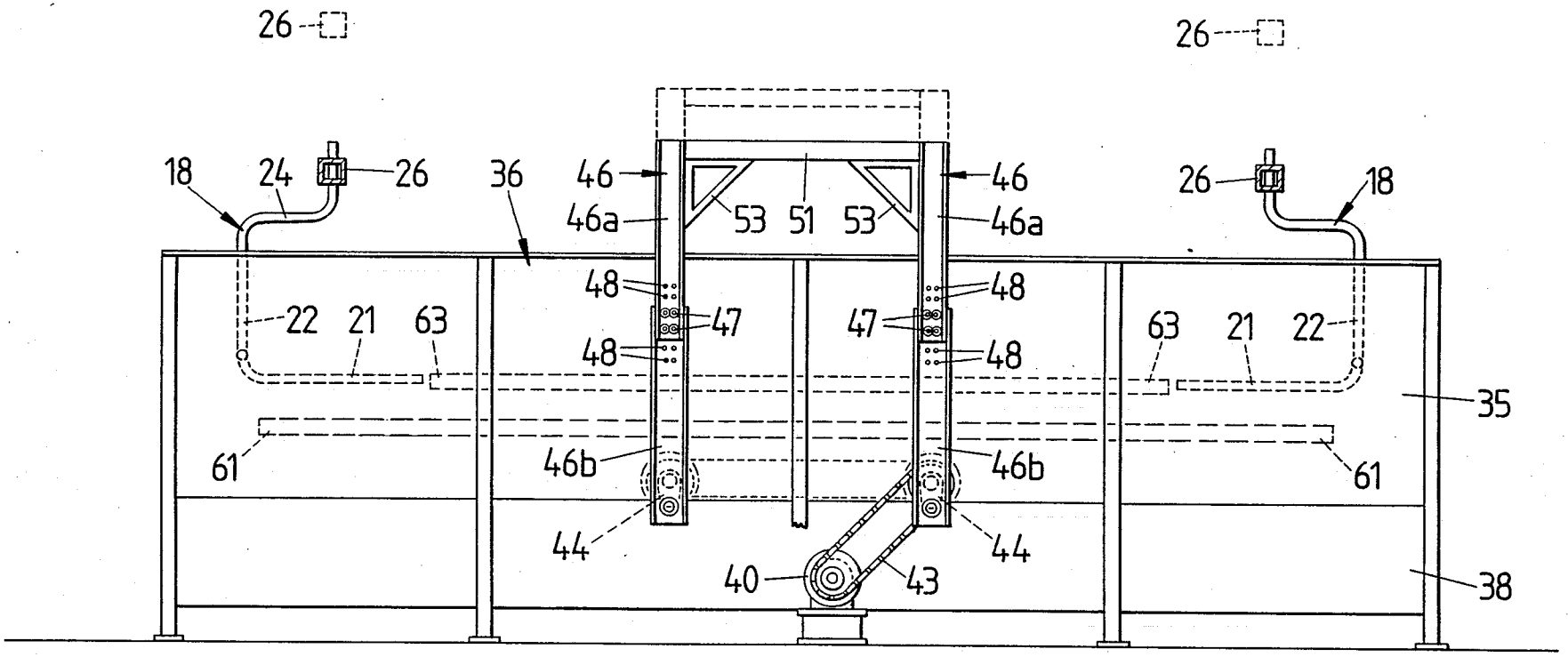
FIG. 3 is a side elevational view of a quenching tank including a walking beam conveyor.
Figure 4:
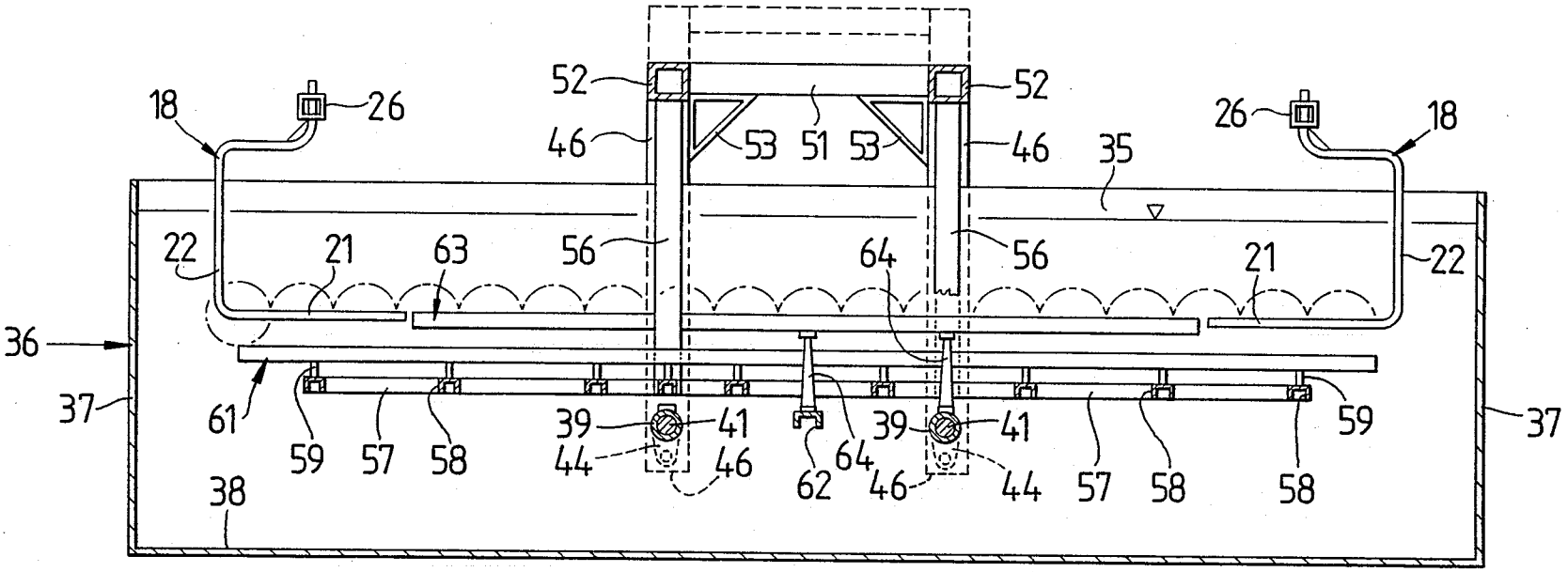
FIG. 4 is a sectional view taken along the longitudinal axis of the tank in FIGS. 3.

The quenching tank 36 has end walls 37 and a bottom 38 in watertight contact with the sidewalls 35 and a pair of watertight sleeves 39 extend across the tank and through the sidewalls 35. Each sleeve 39 has a drive shaft 41 extending therethrough and mounted in bearings 42 at each end of the sleeve 39. Each drive shaft 41 is in turn driven by a suitable motor 40, which may be electric or hydraulic, connected thereto by a belt or chain 43. Each end of each shaft 41 carries an aligned crank arm 44 which supports at the outer end thereof a vertical frame member 46, such that four such frame members are supported in matched pairs on each side of the quenching tank 36 at the ends of the drive shafts 41. Each frame member 46 has an upper and lower portion 46*a* & 46*b* respectively which are connected by bolts 47 passing through selected apertures 48 in their mating ends as shown in FIG. 3. Each vertical frame member 46 is attached at the upper end of portion 46*a* to each adjacent vertical frame member 46 by a lateral spanning member 51, outside the quenching tank 36 and a cross member 52 which extends over the quenching tank 36, with each attachment secured by appropriate braces such as at 53.

Depending from the cross member 52 and inwardly of the sidewalls 35 are four vertical stringers 56 which support at their lower ends a pair of horizontal stringers 57 which extend longitudinally within the quenching tank 36. The horizontal stringers 57 in turn support a plurality of transverse stringers 58 therebetween Each transverse stringer 58 supports a plurality of upright supports 59 which are aligned beneath and support a plurality of longitudinally extending beam members 61 which serve as "walking beams". It will be noted that stringers 56 are of such length that the longitudinal and transverse stringers 57 and 58 are supported above the sleeves 39. The sleeves 39 and additional supports 62 support a plurality of fixed beams 63 on a plurality of stanchions 64, with the fixed beams 63 lying intermediate the walking beams 61 and being somewhat shorter in length. It will be appreciated that rotation of the drive shafts 41 causes a circular motion of the walking beam 61 in the vertical plane such that at the top of thIs circular motion the walking beams 61 rise above the tops of the fixed beams 63. The extent to which the walking beam 61 is above the fixed beam 63 during each rotation can be varied by varying the length of vertical support 46 or vertical stringers 56.

It should be noted that the spacing between the lower portions 21 of structural members 19 of the basket 18 is the same as the spacing between the fixed beams 63 and that when the basket 18 is in its lowermost position in the quenching tank 36 the lower portion 21 and beams 63 are aligned such that the walking beams 61 interstitially engage the lower portions 21. As can be seen in FIG. 1, a basket assembly can be placed at each end of the quenching tank 36 to cooperate with the walking beam conveyor to transport the castings.

In operation, it can be seen that the dump station 12 will lift a flask 66 containing a sand mold and casting from a gondola 67 of the associated foundry casting system 11 and will empty the contents onto the basket 18 which is positioned on the receiving support 17. The sand from within the flask 66 pours from the flask before the casting is discharged in sufficient quantity to cover the lower portion 21 of the basket 18 and thus cushions the impact of the casting dropping into the basket 18. The mechanical actuation of this step is obviously controlled to prevent operation of the dumping station 12 in the absence of a basket 18 and such control can readily be accomplished using limit switches or proximity switches (not shown) which detect the proper placement of the various components and enable the operation of the moving components. When the dump station 12 has deposited the sand and casting into the basket 18 and has retracted to replace the flask 66 on the gondola 67, the vertical ram 34 is actuated to raise the basket 18 above the sidewalls of the receiving station 17. Again, proximity sensors and limit switches may be used to detect compIetion of thIs function and enable further operation of the apparatus. As the basket 18 is raised the sand accumulated thereon passes between the structural members 19 and remains on the receiving support 17 from which it is mechanically removed by vibration or tilting or in any other suitable manner. Drive unit 32 is energized to rotate the turntable assembly through 180° to reverse the position of baskets 18 and 18'. If desirable sprayer units (not shown) may be provided to rinse any remaining sand from the castings as they are carried by the basket 18 from the receiving station 17. A set of limit switches 69 may be mounted beneath the turntable assembly to control the rotation of the assembly such that the baskets 18 & 18' are moved almost precisely 180° by the drive unit. When the rotation has been completed, ram 34 is utilized to lower the turntable such that basket 18' is placed in the receiving station 17 and basket 18 is lowered into alignment with the fixed beams 63. In the embodiment shown, fixed beam 63 is inside a quenching tank 36, which contains a level of quenching liquid, although castings of different metals may require different treatment such that a quenching tank may not be used. The moving beam 61 follows its circular path through the interstices between lower portions 21 and thus rises beneath the casting and urges it toward the stationary beam 63. After several revolutions of the walking beam, depending on the arc which is subtended by the stationary beam 63 and lower portion 21, the casting will be supported on the stationary beam 63 rather than the basket 18. While removal of the casting to stationary beam 63 is occurring, dump station 12 is depositing another casting into basket 18'. When the first casting is removed from basket 18 and a fresh casting deposited into basket 18:, the apparatus translates the baskets to their original positions. The cycle is repeated constantly with the castings proceeding along the walking beam conveyor to a second rotary transporter 71 identical to the one hereinabove described which removes the castings from the walking beam conveyor to another conveyor for processing. It should be noted that the use of rotary transporters at each end of the walking beam greatly facilitates the automation of the quenching tank 36.

From the foregoing it may be seen that the castings are transported from the mold through the quenching tank with minimal impact. It will be appreciated that the rotation of the drive shaft 41 can be controlled and the height of the rise of the walking beam 61 can be controlled, thus, the castings can be moved very gently, yet efficiently through the quenching tank 36. Accordingly, my apparatus greatly improves the quality of the finished product and diminishes the number of castings which must be discarded.

While I have shown my invention in one form, it will be obvious to those skilled in the art that it is not so limited but is susceptible of various changes and modifications without departing from the spirit thereof.

What I claim is:

1. Apparatus for handling hot foundry castings discharged from sand molds, without damage thereto comprising:

(a) means for receiving a foundry casting and a quantity of encasing sand from an associated sand mold including means pervious to said encasing sand for supporting said foundry casting;

(b) means for vertically moving said means for supporting such that said means for supporting segregates said foundry casting from said sand;

(c) means for translating said means for supporting such that said means for supporting is displaced laterally to a predetermined position including a turntable which is mounted for rotation about a vertical axis with a means for driving said turntable to precise angular positions and also with an elongated beam member affixed to said turntable and extending radially therefrom and having a distal end which is permanently attached to said supporting means; and (d) means subjacent said displaced position capable of interstitial engagement with said supporting means for removing said foundry casting from said means for supporting.

2. Apparatus as defined in claim 1 wherein said means for receiving further comprises means for supporting said encasing sand upon initial delivery thereto and discharge of said sand therefrom upon segregation of said sand and foundry casting by said means for supporting.

3. Apparatus for handling hot foundry castings, discharged from sand molds, without damage thereto comprising:

(a) means for receiving a foundry casting and a quantity of encasing sand from an associated sand mold including means pervious to said encasing sand for supporting said foundry casting including means for supporting said encasing sand upon initial delivery thereto and discharge of said sand therefrom upon segregation of said sand and foundry casting by said means for supporting wherein said means for supporting comprises a basket assembly including a plurality of coplanar parallel elongated members spaced equidistantly and with each of said elongated members having a first portion extending horizontally and a second portion extending generally vertically with said elongated members being rigidly connected along said second portion, with selected ones of said elongated members extending upwardly for engagement with said means for translating;

(b) means for vertically moving said means for supporting such that said means for supporting segregates said foundry casting from said sand;

(c) means for translating said means for supporting such that said means for supporting is displaced laterally to a predetermined position; and (d) means subjacent said displaced position capable of interstitial engagement with said supporting means for removing said foundry casting from said means for supporting.

4. Apparatus as defined in claim 3 wherein said means for translating comprises:

(a) a turntable mounted for rotation about a vertical axis;

(b) means for driving said turntable for rotation to precise angular positions; and (c) an elongated beam member affixed to said turntable and extending radially therefrom and having a distal end for engagement with said supporting means.

5. Apparatus as defined in claim 4 wherein said means for vertically moving comprises a linear actuator mounted vertically beneath said means for translating for raising and lowering said means for translating and said means for supporting.

6. Apparatus as defined in claim 4 wherein said turntable comprises:

(a) a cruciform member affixed to the top of said means for vertically moving and supporting said means for rotating;

(b) caster-like members supported on said cruciform members with a pair of caster-like members mounted on opposing extensions thereof for rotation about a common horizontal axis; and (c) a plate-like member movably supported on said caster-like member and operatively connected to said means for driving for rotation in a plane defined by the top of said caster-like members.

7. Apparatus as defined in claim 6 wherein said means for removing said foundry castings is a walking beam conveyor.

8. Apparatus for handling hot foundry castings discharged from sand molds, without damage thereto comprising;

means for receiving a foundry casting and quantity of encasing sand from an associated sand mold including means pervious to said encasing sand for supporting said foundry casting wherein said means for supporting comprises a basket assembly including a plurality of coplanar parallel elongated members spaced equidistantly and with each of said elongated members having a first portion extending horizontally and a second portion extending generally vertically with said elongated members being rigidly connected along said second portion, with selected ones of said elongated members extending upwardly for engagement with said means for translating;

(b) means for vertically moving said means for supporting such that said means for supporting segregates said foundry casting from said sand;

(c) means for translating said means for supporting such that said means for supporting is displaced laterally to a predetermined position; and (d) means subjacent said displaced position capable of interstitial engagement with said supporting means for removing said foundry casting from said means for supporting.

9. Apparatus as defined in claim 8 wherein said means for supporting said encasing sand is a dump table.

10. Apparatus as defined in claim 8 wherein said means for supporting said encasing sand is a vibrating screen conveyor.

11. Apparatus as defined in claim 8 wherein said means for removing said foundry castings is a walking beam conveyor.

12. Apparatus as defined in claim 8 wherein said means for translating comprises:

(a) a turntable mounted for rotation about a vertical axis;

(b) means for driving said turntable for rotation to precise angular positions; and (c) an elongated beam member affixed to said turntable and extending radially therefrom and having a distal end for engagement with said supporting means.

13. Apparatus as defined in claim 12 wherein said turntable comprises:

(a) a cruciform member affixed to the top of said means for vertically moving and supporting said means for rotating;

(b) caster-like members supported on said cruciform member with a pair of caster-like members mounted on opposing extensions thereof for rotation about a common horizontal axis; and (c) a plate-like member movable supported on said caster-like members and operatively connected to said means for driving for rotation in a plane defined by the top of said caster-like members.

14. Apparatus for handling hot foundry castings discharged from sand molds, without damage thereto comprising;

(a) means for receiving a foundry casting and quantity of encasing sand from an associated sand mold including means pervious to said encasing sand for supporting said foundry casting;

(b) means for vertically moving said means for supporting such that said means for supporting segregates said foundry casting from said sand;

(c) means for translating said means for supporting is a turntable for rotation wherein said turntable is comprised of a cruciform member affixed to the top of said means for vertically moving and supporting said means for translating, caster-like members supported on said cruciform member with a pair of caster-like members mounted on opposing extensions thereof for rotation about a common horizontal axis and a plate-like member movably supported on said caster-like members for rotation in a plane defined by the top of said caster-like members with said turntable for rotation mounted about a vertical axis with a means for driving said turntable to precise angular positions and also with an elongated beam member affixed to said turntable and extending radially therefrom and having a distal end affixed to said supporting means; and (d) means subjacent said displaced position capable of interstitial engagement with said supporting means for removing said foundry casting from said means for supporting.

15. Apparatus for transporting foundry castings from a lost foam sand casting line, comprising:

(a) a pervious basket for supporting said castings positioned to receive said castings and associated encasing sand from a casting line;

(b) means permanently affixed to said basket for translating said castings to a position displaced from said casting line; and (c) means for removing said castings from said basket.

16. Apparatus for transporting foundry castings from a lost foam sand casting line, comprising:

(a) a pervious basket for supporting said castings positioned to receive said castings and associated sand from a casting line;

(b) means for translating said castings and said basket to a position displaced from said casting line; and (c) means for removing said castings from said basket wherein said basket comprises a plurality of coplanar parallel elongated members having a first portion extending horizontally and a second portion extending generally vertically with said elongated members being rigidly connected along said second portion, with selected ones of said elongated members extending upwardly for engagement with said means for translating.

17. Apparatus as defined in claim 16 wherein said means for translating comprises:

(a) a turntable mounted for rotation about a vertical axis;

(b) means for driving said turntable for rotation to precise angular positions; and (c) an elongated beam member affixed to said turntable and extending radially therefrom and having a distal end for engagement with said supporting means.

18. Apparatus as defined in claim 17 wherein said means for translating further comprises a vertically oriented linear actuator positioned beneath said turntable and said means for driving such that said means for translating and said basket are selectively positioned at a raised and lowered position.

19. Apparatus as defined in claim 18 wherein said turntable comprises:

(a) support members affixed atop said linear actuator and extending radially therefrom with said means for driving supported thereon;

(b) caster-like members mounted on said support members radially outwardly from said linear actuator for rotation about horizontal axes; and (c) a plate-like member operatively connected to said means for driving and supported by said caster-like members.

20. Apparatus as defined in claim 19 wherein said means for removing said foundry castings is a walking beam conveyor.

21. Apparatus for handling foundry castings comprising:

(a) a first rotary transporter having a plurality of symmetric basket-like members for carrying said castings movable selectively between first position and a second position;

(b) a walking beam conveyor adapted for engaging said basket-like members at said second position and removing castings therefrom;

(c) a processing unit cooperatively positioned adjacent said walking beam conveyor; and (d) a second rotary transporter for removing said foundry castings from said walking beam conveyor.

22. Apparatus as defined in claim 21 wherein said walking beam conveyor comprises a plurality of parallel fixed beams and a plurality of parallel moving beams moving interstitially relative to said fixed beams in a circular path in a plane perpendicular to said beams, and each of said basket-like members includes a plurality of elongated parallel members adapted for alignment with said fixed beam members at said second position.

23. Apparatus as defined in claim 21 wherein said processing unit is a quenching tank with said walking beam conveyor mounted therewithin such that said fixed beams and moving beams remain submerged within a liquid therewithin.

* * * * *